US009468800B2

(12) United States Patent
Guerrero

(10) Patent No.: US 9,468,800 B2
(45) Date of Patent: Oct. 18, 2016

(54) NECK SUPPORT APPARATUS FOR ABDOMINAL EXERCISES

(71) Applicant: Regina De Leon Guerrero, Oak Harbor, WA (US)

(72) Inventor: Regina De Leon Guerrero, Oak Harbor, WA (US)

( * ) Notice: Subject to any disclaimer, the term of this patent is extended or adjusted under 35 U.S.C. 154(b) by 101 days.

(21) Appl. No.: 13/948,126

(22) Filed: Jul. 22, 2013

(65) Prior Publication Data

US 2015/0024913 A1 Jan. 22, 2015

(51) Int. Cl.
*A63B 71/00* (2006.01)
*A63B 26/00* (2006.01)
*A63B 23/02* (2006.01)

(52) U.S. Cl.
CPC ..... *A63B 23/0211* (2013.01); *A63B 21/4039* (2015.10)

(58) Field of Classification Search
CPC .. A63B 23/00; A63B 23/02; A63B 23/0205; A63B 23/0211; A63B 23/025; A63B 21/00047; A63B 2023/006
USPC ..... 482/140, 142, 148, 907
See application file for complete search history.

(56) References Cited

U.S. PATENT DOCUMENTS 1,904,039 A * 4/1933 Bruder ..... A61H 7/001 482/142
4,230,099 A * 10/1980 Richardson ..... A61F 5/01 606/240
4,333,248 A * 6/1982 Samuels ..... A43B 3/18 36/101
4,752,067 A * 6/1988 Colonello ..... A63B 21/4039 482/140
4,995,604 A * 2/1991 Lynch ..... A63B 21/0606 434/254
D321,386 S * 11/1991 Reichman ..... D21/687
5,147,267 A * 9/1992 Kunewalder ..... A63B 21/0004 482/142
D331,270 S * 11/1992 Johnson ..... D21/687
5,169,372 A * 12/1992 Tecco ..... A63B 21/0004 482/105
5,267,931 A * 12/1993 Faetini ..... A61H 1/0296 128/DIG. 23
D343,877 S * 2/1994 Yin ..... D21/690
5,330,399 A * 7/1994 Fan ..... A63B 22/16 403/291
5,337,427 A * 8/1994 Pagano ..... A61G 13/0009 128/845
5,433,688 A * 7/1995 Davies ..... A63B 21/0552 482/124
5,545,114 A * 8/1996 Gvoich ..... A63B 21/4011 482/123
5,792,035 A 8/1998 Ward et al.
5,807,220 A * 9/1998 Allis ..... A63B 23/0211 482/131

(Continued)

*Primary Examiner* — Stephen Crow
*Assistant Examiner* — Garrett Atkinson
(74) *Attorney, Agent, or Firm* — The Keys Law Firm PLLC

(57) ABSTRACT

A neck support apparatus for performing abdominal exercises without causing or exacerbating neck discomfort. The neck support apparatus comprises an hourglass shaped body having three distinct sections and a removable handle portion. The body includes an upper portion adapted to receive and support the back of a user's head, a middle portion adapted to receive and support the back of a user's neck, and a lower portion adapted to receive and support the back of a user's shoulders. The handle portion is removably attachable to the back side of the body through the use of corresponding aspects of a hook and loop fastener system and includes a slidable grip disposed thereon.

12 Claims, 1 Drawing Sheet

(56) References Cited

U.S. PATENT DOCUMENTS 5,888,181 A * 3/1999 Yeh ..... A63B 23/00 482/131
5,913,757 A * 6/1999 Winters ..... A63B 23/0211 482/123
D418,563 S * 1/2000 Hwang ..... D21/688
D428,948 S * 8/2000 Gebhard ..... D21/686
6,224,524 B1 * 5/2001 Singh ..... A43B 5/18 36/136
6,319,180 B1 * 11/2001 Kallassy ..... A63B 23/0211 482/139
D456,084 S * 4/2002 Smith ..... D21/687
6,663,546 B2 12/2003 Kallassy
6,997,857 B2 * 2/2006 Bowman ..... A63B 23/0222 482/121
D651,262 S * 12/2011 Kabbani-Crawford ..... D21/686
8,632,445 B2 * 1/2014 Kim ..... A63B 21/4035 482/140
8,702,570 B1 * 4/2014 DelPriore ..... A63B 21/4049 482/123
2005/0137064 A1 * 6/2005 Nothnagle ..... A63B 21/0726 482/108
2010/0273617 A1 * 10/2010 Mills ..... A63B 23/0211 482/140
2011/0269605 A1 * 11/2011 Kim ..... A63B 21/4035 482/121
2012/0058868 A1 3/2012 Mills et al.
2013/0190151 A1 * 7/2013 Scholder ..... A63B 21/4039 482/142

* cited by examiner

NECK SUPPORT APPARATUS FOR ABDOMINAL EXERCISES

BACKGROUND OF THE INVENTION

1. Field of the Invention

This invention relates generally to exercise devices and, more particularly, to a neck support apparatus which reduces strain and relieves pain while conducting abdominal exercises.

2. Description of the Prior Art

The use of neck support devices which provide general support to reduce strain and relieve pain are well known. One common constraint of general neck support devices is that they are not designed to support the neck while a user is exercising. Thus, a problem which exists is that general neck support devices do not provide adequate support during the performance of common abdominal exercises, many of which can cause or exacerbate neck discomfort. Consequently, there remains a need for a neck support apparatus which provides support while performing abdominal exercises to reduces or eliminates neck discomfort often associated with such exercises. It would be helpful if such a neck support apparatus could be operated by a user acting alone or a user working with a partner or trainer. It would be additionally desirable for such a neck support apparatus to additionally allow an individual to safely assist anyone sit up from a supine position.

The Applicant's invention described herein provides for a neck support apparatus adapted to allow a user to reduce neck strain and relieve neck pain while safely performing abdominal exercises. The primary components of Applicant's neck support apparatus are an hourglass shaped body and a moveable handle removably attached to said body. When in operation, the neck support apparatus provides support throughout the range of motion of abdominal exercises such as a sit-up or crunch. The provision of such support allows a user to perform without requiring neck straining or causing or exacerbating neck pain. As a result, many of the limitations imposed by existing neck support devices are removed.

SUMMARY OF THE INVENTION

A neck support apparatus for performing abdominal exercises without causing or exacerbating neck discomfort. The neck support apparatus comprises an hourglass shaped body having three distinct sections to provide a body means for support and a removable handle portion to provide a handle means for grasping. The body includes an upper portion adapted to receive and support the back of a user's head and provide a means for head support, a middle portion adapted to receive and support the back of a user's neck and provide a means for neck support, and a lower portion adapted to receive and support the back of a user's shoulders and provide a means for shoulder support. The handle portion is removably attachable to the back side of the body through the use of corresponding aspects of a hook and loop fastener system and includes two slidable grips disposed thereon. In this manner, the hook and loop fastener system provides a means for fastening.

When in use, a user first configures the neck support apparatus by attaching the handle portion to the back side of the body in a desirable location for that user. The user then sets up the neck support apparatus by laying the back side of the neck support apparatus on the ground. The user then engages the neck support apparatus by lying down on it with her head in the upper portion, her neck on the middle portion, and her shoulder blades on the lower portion. The user actuates the neck support apparatus by grasping each handle portion with one hand while performing the desired abdominal exercises. When used with a trainer or other assistance, a user engaging the neck support apparatus would actuate the neck support apparatus by having the trainer grasp one handle portion with one hand and the back side of the middle portion with the other hand while the user performs the desired abdominal exercises It is an object of this invention to provide a neck support apparatus which provides support while performing abdominal exercises to reduces or eliminates neck discomfort often associated with such exercises.

It is another object of this invention to provide a neck support apparatus which can be properly operated by a user acting alone or a user working with a partner or trainer.

It is yet another object of this invention to provide a neck support apparatus to additionally allow individuals to safely assist anyone in sitting up from a supine position.

These and other objects will be apparent to one of skill in the art.

DETAILED DESCRIPTION OF THE INVENTION

Figure 1:
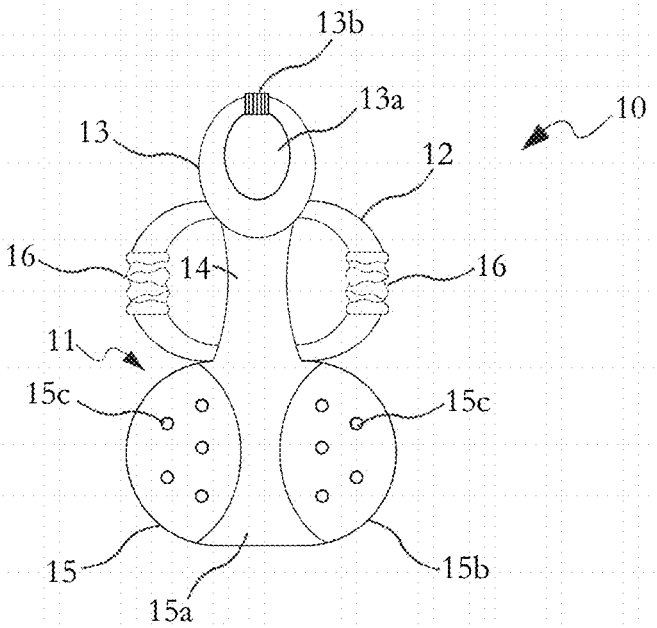
FIG. 1 is a front elevational view of a neck support apparatus built in accordance with the present invention having its removable handle portion attached thereto.

Referring now to the drawings and in particular FIG. 1, the front side of a neck support apparatus 10 for performing abdominal exercises is shown having an hourglass shaped body 11 and a removable handle portion 12. The body 11 of the neck support apparatus has three distinct sections, an upper portion 13, a middle portion 14 and a lower portion 15. The handle portion 12, which is selectively attachable to the back side of the body 11 of the neck support apparatus, includes a slidable grip 16 disposed thereon.

Figure 2A:
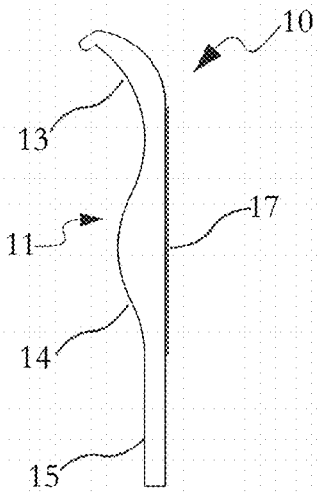
FIG. 2*a* is a side elevational view of the body of a neck support apparatus built in accordance with the present invention having its removable handle portion detached.
Figure 2B:
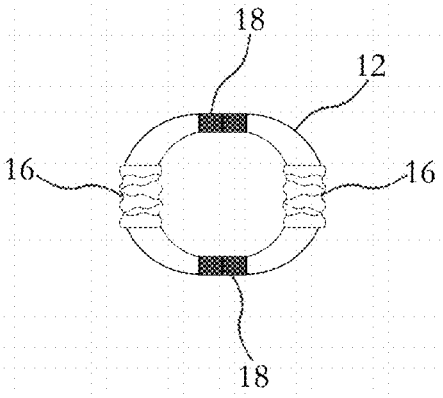
FIG. 2*b* is a front elevational view of the handle portion of a neck support apparatus built in accordance with the present invention.

Referring now to FIGS. 2*a* and 2*b*, the handle portion 12 is shown, detached from the body 11 of the neck support apparatus 10, having an elliptical shaped structure having one grip 16 disposed on opposing sides. The body 11 and the handle portion 12 utilize corresponding aspects of a hook and loop fastener system to allow the handle portion 12 to be removably attached to the back side of the body 11. In this regard, a section of loop fastener material 17 is permanently attached on the back side of the body 11 and two sections of hook fastener material 18 are permanently attached to the handle portion 12. It is contemplated that the loop fastener material 17 is used on the back side of the body 11 so as to allow the back side of the body 11 to not be prone to inadvertently attach to the surface on which the neck support apparatus is laid and to allow a user to comfortably place their hand on the back side of the body while using the device.

The three sections of the body 11 are each specifically adapted to provide a desirable type and amount of support to the part of the user's body which contacts the section when the neck support apparatus is in use. The upper portion 13 of said body 11 is adapted to receive the back of a user's head. Consequently it is defined by a ring structure which includes an aperture 13*a*. The ring structure is sized to receive the back of the user's skull in a manner which allows the skull to be naturally supported in a neutral position and relieves what is typically the neck's burden of supporting the head in such a position. The ring structure additionally includes an upper handle 13*b* which allows the neck support apparatus to be easily transportable. The aperture 13*a* provides a place for a user with longer hair to put their hair through so that flush contact with the right structure is maintained.

The middle portion 14 of said body 11 is adapted to receive the back of a user's neck. It is therefore defined by an elevated cushion anatomically designed to hold a user's cervical spine in a desirable manner so as to relieve any strain of the neck muscles and reduce the chance for irritation or pain of the user's neck. In the preferred embodiment, the cushion is made up of viscoelastic memory foam like material and covered in synthetic leather material so that it is comfortable yet provides the necessary support.

The lower portion 15 of the body 11 is adapted to receive the back of a user's shoulders. It includes a spine area 15*a* which is made up of the same material as the cushion of the middle portion 14 so as to conform to the space between the shoulders and a shoulder area 15*b* which is made up of a heavy duty plastic material similar to the rest of the apparatus and includes a plurality of air holes 15*c* for ventilation. This structure allows the body 11 to provide a rigid structure configured to remain in contact with the upper back and spine so as to promote the user to engage her abdominal muscles when performing the abdominal exercise (as opposed to the user's upper back or neck—which is a common error). The heavy duty plastic material allows the body 11 to be cleaned and sanitized easily.

The handle portion 12 is constructed of a canvas material. The grips 16 include a hole in the middle so as to allow them to selectively slide up and down the handle portion 12 and set by a user in a comfortable position.

When in use, a user attaches the handle portion 12 to the back side of the body in a desirable location for that user and lays the back side of the neck support apparatus 10 on the ground. The user then lays down in the neck support apparatus so that her head contacts the upper portion 13, her neck contacts the middle portion 14, and her shoulder blades contact the lower portion 15. Next, the handle portion 12 can be grasped with one hand on one grip 16 and one hand on the back side of the middle portion 14 or one hand on each grip 16. At that point, the neck support apparatus can be used to perform abdominal exercises like sit-ups or crunches without causing or exacerbating neck discomfort because support can be provided through either the handle portion 12 or the back side of the middle portion 14.

If the neck support apparatus is used alone, it is understood that the user would typically grasp each grip 16 with one hand. If the neck support apparatus is used with a trainer, caregiver or other assistance, the assisting person grasps one side of the handle portion 12 at a grip 16 with one hand and the back side of the middle portion 14 with the other hand. In such an arrangement, the user's hands are left free while an abdominal exercising movement, such as sitting up from a bed or an abdominal exercise, is performed.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A neck support apparatus for performing abdominal exercises, comprising:

an elongated support body having a front side configured to contact a user's head, neck and upper back and a back side configured to contact the ground with a single continuous flat bottom; and a handle portion defined by an ellipse and adapted to be removable attached to the back side of said support body through a fastener system by way of the back side of said support body having one aspect of the fastener system and the handle portion having a reciprocal aspect of the fastener system; wherein said support body includes: an upper portion adapted to receive and support a user's head in a neutral position; a middle portion which is narrower that the upper portion and connected to said upper portion which is configured to receive and hold a user's cervical spine in a neutral position; and a lower portion which is wider that the upper portion and connected to said middle portion which configured to receive and hold a user's shoulders in place; wherein said middle portion includes a cushion; and wherein said lower portion includes opposing shoulder areas which each have a plurality of air holes and a spine area which passes between the shoulder areas and is contiguous with the cushion of the middle portion.

2. The neck support apparatus of claim 1, wherein said upper portion defines a curved member with a centrally disposed aperture therein, thereby adapting the upper portion to receive and support a user's head in a neutral position.

3. The neck support apparatus of claim 1, wherein said cushion is constructed of viscoelastic memory foam.

4. The neck support apparatus of claim 1, wherein said handle portion includes at least one grip disposed thereon.

5. The neck support apparatus of claim 4, wherein said at least one grip is slidably disposed on the handle portion.

6. The neck support apparatus of claim 1, wherein said fastener system defines a hook and loop fastener system, with the back side of said body including the loop aspect of the hook and loop fastener system while the handle portion includes the hook aspect of the hook and loop fastener system.

7. The neck support apparatus of claim 1, wherein said handle portion includes a pair of grips disposed in opposing positions thereon.

8. A neck support apparatus for performing abdominal exercises, comprising:

an elongated support body having a front side configured to contact a user's body, a back side configured to contact the ground with a single continuous flat bottom, a right lateral edge and a left lateral edge;

said support body including a first section, a second section which includes opposing shoulder areas, and a contiguous, centrally disposed support cushion adapted to support a user's cervical spine and conform to the space between the shoulder areas; and said first section defining a curved upper portion of the support body with a centrally disposed aperture that passes through the support body, thereby adapting the first section to support a user's head in a neutral position; wherein said second section defines a middle portion of the support body and a lower portion of the support body; said contiguous, centrally disposed support cushion extends between the middle portion and lower portion; and said shoulder areas are disposed on said lower portion; and wherein said shoulder areas are each constructed of a rigid material and each have a plurality of air holes.

9. The neck support apparatus of claim 8, additionally comprising a handle portion adapted to be removable attached to said support body so as to extend laterally beyond at least one of the right lateral edge and left lateral edge.

10. The neck support apparatus of claim 9, wherein the handle portion includes a pair of grips disposed in opposing positions thereon and the handle portion is adapted to be attached to said support body such that one of said pair of grips extends beyond the right lateral edge and the other of said pair of grips extends beyond the left lateral edge.

11. The neck support apparatus of claim 10, wherein the handle portion is portion is adapted to be attached to said support body such that the pair of grips are positioned between the first section and the shoulder areas.

12. The neck support apparatus of claim 8, wherein said middle portion is narrower that the upper portion and said lower portion is wider that the upper portion.

* * * * *